US006010192A

United States Patent [19]

King

[11] Patent Number: 6,010,192

[45] Date of Patent: Jan. 4, 2000

[54] TRAVEL PILLOW

[76] Inventor: Jenny K. King, 501 Broadmoor Ave., Houma, La. 70364

[21] Appl. No.: 09/124,660

[22] Filed: Jul. 29, 1998

[51] Int. Cl.[7] ..... A47C 7/38

[52] U.S. Cl. ..... 297/397; 297/391; 297/399; 297/400; 297/402; 297/217.4; 5/639

[58] Field of Search ..... 297/397, 399, 297/400, 402, 217.4, 391; 5/636, 639, 904

[56] References Cited

U.S. PATENT DOCUMENTS

| | | | |
|---|---|---|---|
| 2,573,186 | 10/1951 | Mier | 297/399 |
| 2,587,196 | 2/1952 | Morecroft | 297/397 |
| 2,801,677 | 8/1957 | Pinkerton et al. | 297/397 |
| 2,908,766 | 10/1959 | Taylor | 312/235.2 X |
| 2,983,310 | 5/1961 | Warlick et al. | 5/636 X |
| 2,996,333 | 8/1961 | Kinsman | 297/399 |
| 3,029,107 | 4/1962 | Myers | 297/399 |
| 3,046,057 | 7/1962 | Smetko | 297/397 |
| 3,062,586 | 11/1962 | Rowland | 297/397 |
| 3,226,159 | 12/1965 | Binding | 297/397 |
| 3,253,859 | 5/1966 | Merriman et al. | 297/397 |
| 3,292,973 | 12/1966 | Cogut | 297/397 |
| 3,369,786 | 2/1968 | SChloemer | 297/397 X |
| 3,385,393 | 5/1968 | Gold | 297/397 X |
| 3,387,886 | 6/1968 | Longo et al. | 297/397 |
| 3,480,976 | 12/1969 | Yavner | 5/636 X |
| 3,512,605 | 5/1970 | McCorkle | 297/397 X |
| 3,578,383 | 5/1971 | Earl | 297/391 |
| 3,608,964 | 9/1971 | Earl | 297/397 |
| 4,030,781 | 6/1977 | Howard | 297/397 |
| 4,031,578 | 6/1977 | Sweeney et al. | 5/636 X |
| 4,114,948 | 9/1978 | Perkey | 297/397 |
| 4,165,125 | 8/1979 | Owen | 297/397 X |
| 4,206,945 | 6/1980 | Kifferstein | 297/397 X |
| 4,383,713 | 5/1983 | Roston | 297/397 X |
| 4,440,443 | 4/1984 | Nordskog | 297/217.4 X |
| 4,490,842 | 12/1984 | Watanabe | 297/391 X |
| 4,498,704 | 2/1985 | Hildreth | 297/400 X |
| 4,679,262 | 7/1987 | Davis et al. | 5/636 |
| 4,979,777 | 12/1990 | Takada | 297/217.4 X |
| 5,143,055 | 9/1992 | Eakin | 297/217.4 X |
| 5,273,342 | 12/1993 | Pratt | 297/399 X |
| 5,411,468 | 5/1995 | Chen | 297/217.3 X |
| 5,505,523 | 4/1996 | Wang | 297/397 X |
| 5,567,015 | 10/1996 | Arias | 297/397 |
| 5,624,156 | 4/1997 | Leal et al. | 297/219.12 |
| 5,690,387 | 11/1997 | Sarti | 297/397 |
| 5,800,019 | 9/1998 | Knightlinger | 297/397 X |

FOREIGN PATENT DOCUMENTS

| | | | |
|---|---|---|---|
| 225872 | 7/1962 | Austria | 297/397 |
| 993749 | 1/1951 | France | 297/399 |
| 1259088 | 3/1961 | France | 297/217.4 |
| 91424 | 6/1968 | France | 297/397 |
| 2696388 | 4/1994 | France | 297/391 |
| 1007484 | 5/1957 | Germany | 297/399 |
| 2349425 | 4/1975 | Germany | 297/217.4 |
| 90890 | 12/1957 | Norway | 297/397 |
| 210439 | 6/1966 | Sweden | 297/397 |
| 385441 | 12/1932 | United Kingdom | 297/397 |
| 1208656 | 4/1968 | United Kingdom | 297/399 |
| 1411528 | 10/1975 | United Kingdom | 297/397 |
| WO 93/01951 | 2/1993 | WIPO | 297/217.4 |

*Primary Examiner*—Peter M. Cuomo
*Assistant Examiner*—Rodney B. White
*Attorney, Agent, or Firm*—Henderson & Sturm

[57] ABSTRACT

A travel pillow having a channel formed into a pillow member having a slope adapted for contoured support of the head and neck of the user and a rubber backed flap extending from the lower side edge thereof that extends downwardly past the back and shoulders of the user to allow the weight from the user's back and shoulder area to maintain the pillow in a fixed position during use. An alternate embodiment provides mounting brackets for attachment to a car seat. Also, the pillow may optionally include a massage vibrator powered by the vehicle's cigarette lighter, and stereo speakers connected to the vehicle sound system

1 Claim, 1 Drawing Sheet

TRAVEL PILLOW

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of support cushions, and more particularly to a head support cushion for supporting a user's head and neck when reposing in a sitting position.

2. Description of Related Art

As can be seen by reference to the following U.S. Pat. Nos. 2,983,310; 3,480,976; 3,578,383; 3,608,964; 4,031,578; and 4,679,262, the prior art is replete with myriad and diverse head support cushions.

While all of the aforementioned prior art constructions are more than adequate for the basic purpose and function for which they have been specifically designed, they are uniformly deficient with respect to their failure to provide a simple, efficient, and practical travel pillow to stabilize the user's head and neck against back and forth movement.

As a consequence of the foregoing situation, there has existed a longstanding need for a new and improved travel pillow and the provision of such a construction is a stated objective of the present invention.

BRIEF SUMMARY OF THE INVENTION

Briefly stated, the present invention provides a travel pillow having a channel formed into a pillow member having a slope adapted for contoured support of the head and neck of the user and a rubber backed flap extending from the lower side edge thereof that extends downwardly past the back and shoulders of the user to allow the weight from the user's back and shoulder area to maintain the pillow in a fixed position during use. An alternate embodiment provides mounting brackets for attachment to a car seat. Also, the pillow may optionally include a massage vibrator powered by the vehicle's cigarette lighter, and stereo speakers connected to the vehicle sound system.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
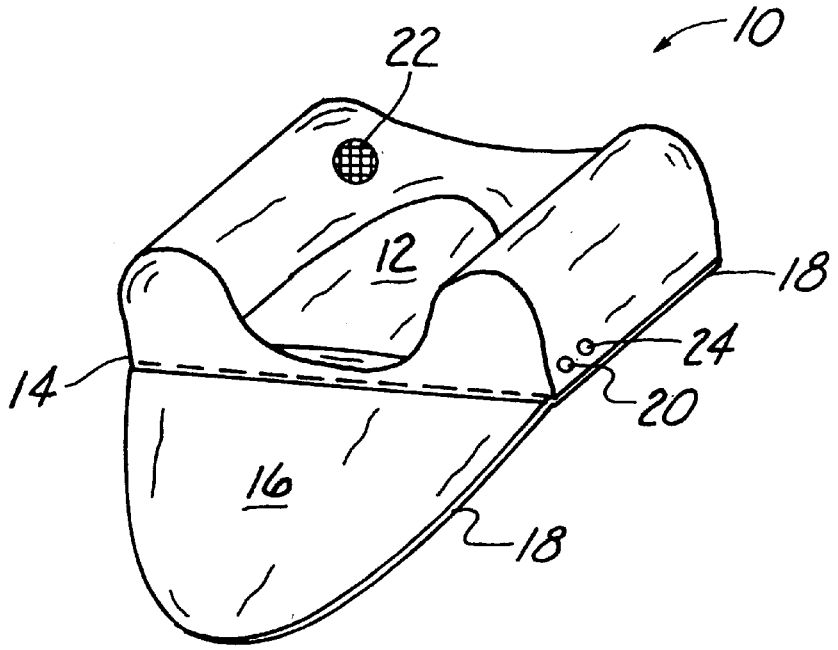
FIG. 1 is a perspective view of the travel pillow of the present invention.

As can be seen by reference to the drawings, and in particularly to FIG. 1, the travel pillow that forms the basis of the present invention is designated generally by the reference number 10. The travel pillow 10 may be fabricated of foam rubber and it includes an angled cut out area 12 in the center that serves to provide lateral support for the neck and head when in use. The travel pillow features a removable outer cover fabricated of fabric or sheepskin that is held in place with a VELCRO closure 14. A small blanket type fabric piece 16 with a rubberized backing 18 attaches along the bottom of the pillow 10, serving to help hold it place when in use. The travel pillow 10 incorporates a massage vibrator that would plug into the vehicle's cigarette lighter through a power port 20, and a pair of small stereo speakers 22 connected to the vehicle sound system through port 24.

Figure 2:
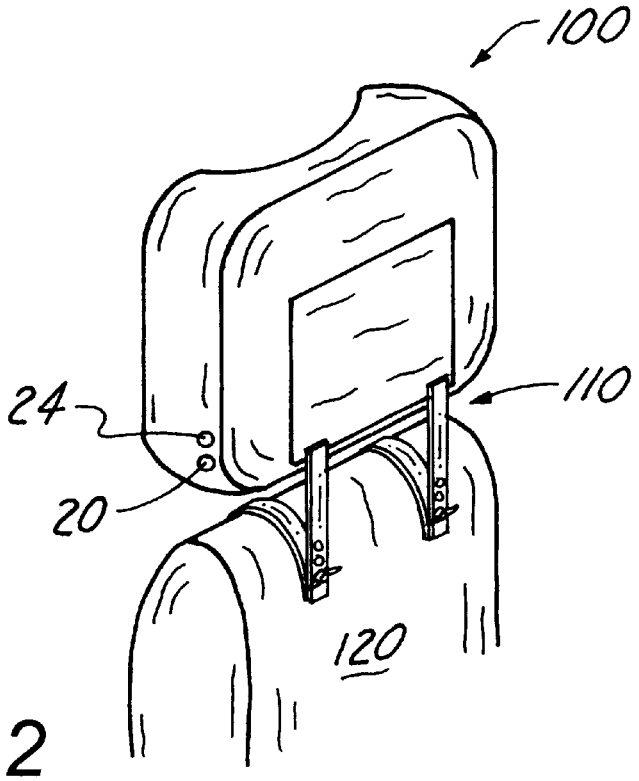
FIG. 2 is a rear perspective view of an alternate embodiment of the travel pillow attachable by a bracket to a car seat.

An alternate embodiment is illustrated in FIG. 2 where the travel pillow 100 includes a plastic or hard rubber adjustable bracket assembly 110 for attachment to a vehicle seat back 120.

In use, one who is traveling simply places the travel pillow 10 and attached blanket component 16 under their neck and head and enjoy the benefit of having an extremely comfortable pillow that provides lateral support, thus preventing their head from moving from side to side. Use of the travel pillow 10 provides a very easy to use and inexpensive method of allowing one to more easily rest while traveling in a vehicle. The travel pillow 10 also may be used while traveling on other forms of transportation as well, such as on a plane, train, or bus. This uniquely designed pillow 10 is an indispensable traveling aide for anyone, young or old. It stabilizes the neck and head against jerking side to side movement that causes neck pain and interrupts peaceful sleep.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A travel pillow, consisting of:

a padded body member having a contoured head and neck support, lateral sides, and a rubberized backing;

a flap attached to the padded body member and disposed to extend down therefrom wherein the flap includes a non-slip rubber backing;

sound speakers carried in the padded body member, the sound speakers being attachable to a vehicle sound system through a first port carried in a first of the lateral sides of the padded body member; and a massage vibrator carried in the padded body member, the massage vibrator being attachable to a vehicle power system through a second port carried in the first of the lateral sides of the padded body member.

* * * * *